United States Patent [19]

Humphrey

[11] Patent Number: 4,488,728

[45] Date of Patent: Dec. 18, 1984

[54] ARCHERY ARROW HAVING A COLLAPSIBLE TAIL ASSEMBLY

[76] Inventor: Stanley A. Humphrey, 3212 3rd Ave. South, Minneapolis, Minn. 55408

[21] Appl. No.: 507,055

[22] Filed: Jun. 23, 1983

Related U.S. Application Data

[63] Continuation-in-part of Ser. No. 373,429, Apr. 30, 1982, abandoned.

[51] Int. Cl.[3] ..... F41B 5/02

[52] U.S. Cl. ..... 273/423

[58] Field of Search ..... 273/423, 420; D22/12; 244/3.24–3.3

[56] References Cited

U.S. PATENT DOCUMENTS

| | | | |
|---|---|---|---|
| 3,595,579 | 7/1971 | Benoit | 273/423 |
| 3,756,602 | 9/1973 | Carella | 273/423 |
| 4,392,654 | 7/1983 | Carella | 273/423 |

FOREIGN PATENT DOCUMENTS

| | | | |
|---|---|---|---|
| 458220 | 7/1949 | Canada | 244/3.24 |

*Primary Examiner*—Paul E. Shapiro

*Attorney, Agent, or Firm*—Clayton R. Johnson

[57] ABSTRACT

An archery arrow having a collapsible tail assembly that includes an arrow shaft having three vanes adjacent its butt end that are generally symetrically located relative the shaft peripheral surface, each vane being made of a piece of semi rigid plastic or plastic cloth material that has axially elongated first and second edge portions secured to the shaft with the first edge portions being longer than, and extending forwardly of, the second edge portion and a loop portion extending angularly between said edge portions and extending away from the shaft to in conjunction with the shaft provide bounded areas of progressively smaller cross section areas in transverse planes that are perpendicular to the shaft axis in a rearward direction. The juncture of the loop with the first edge portion along its length is angularly offset relative the shaft peripheral surface so that as air passes through the vane when the arrow is being shot, the air imparts a turning force to the arrow. In the first embodiment, the vane first and second edge portions are angularly spaced while in the second embodiment the second edge portion is secured to the first. As to the third embodiment, which is the preferred embodiment, the vane loop portion instead of providing bounded areas of progressively smaller cross sections in transverse planes that are perpendicular to the shaft axis in a rearward direction provides bounded areas that are of at least substantially the same size and shape, if not the same size and shape.

9 Claims, 12 Drawing Figures

ARCHERY ARROW HAVING A COLLAPSIBLE TAIL ASSEMBLY

CROSS REFERENCE TO RELATED APPLICATIONS

This application is a continuation-in-part application of my application Ser. No. 373,429, filed Apr. 30, 1982, now abandoned.

BACKGROUND OF THE INVENTION

An archery arrow having vanes adjacent its butt end.

In the prior art, it is old to provide arrows having fletches made of feathers or of pieces of plastic that are planar, however, such prior art fletches cause undesirable deflections of the arrow when being shot due to the fletches coming in contact with the bow handle, and there is undesirable yawing of the butt end. The above reduces accuracy. Accuracy can be increased by making such prior art fletches of larger sizes, however, the larger size fletches results in more drag and lower velocity. Also such prior art fletches can cause deflection of an arrow as it passes too close to a twig or branch, for example when hunting.

Also it is old to provide an arrow having two vanes wherein the vanes have support portions secured to the arrow shaft to extend tangentially away therefrom in parallel relationship and on opposite sides of the shaft, and second vane portions disposed substantially 90° to the support portion and joined thereto to be inclined toward the shaft in a rearward direction (see U.S. Pat. No. 4,012,043).

In order to decrease the magnitude of and/or overcome problems such as the above, this invention has been made.

SUMMARY OF THE INVENTION

An archery arrow having a collapsible tail assembly that includes an arrow shaft and a plurality of vanes adjacent the shaft butt end, each vane having an axially elongated first end portion secured to the shaft and a loop portion joined to the first end portion that extends axially and permits air moving axially therethrough.

One of the objects of this invention is to provide on the butt end portion of an arrow shaft, new and novel means to impart stability to the arrow in flight. A further object of this invention is to provide new and novel collapsible means on an arrow shaft to minimize or alleviate deflection of the arrow shaft as the arrow in being shot has its butt end portion pass in contact with the bow handle. Another object of this invention is to provide new and novel vanes means on an arrow shaft butt end portion to minimize or eliminate yawing of the arrow butt end portion when the arrow is in flight.

BRIEF DESCRIPTION OF THE DRAWINGS

Referring to FIGS. 1–6, the first embodiment of the invention includes an axially elongated circular cylindrical arrow shaft 11 that at its front end mounts an arrow head 12 and at its butt end mounts a nock 13. It is to be noted that parts 11, 12 and 13 can be made as separate members of different materials or as a unitary, single member.

Figure 1:
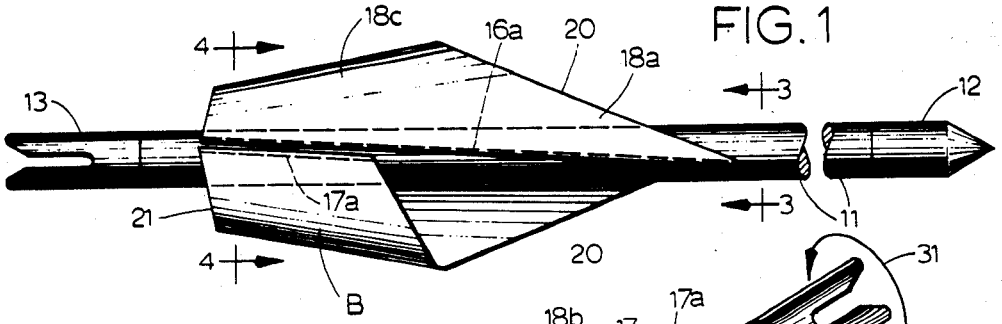
FIG. 1 is a plan view of the first embodiment of the arrow of this invention with the major part of the intermediate portion of the shaft broken away.
Figure 2:
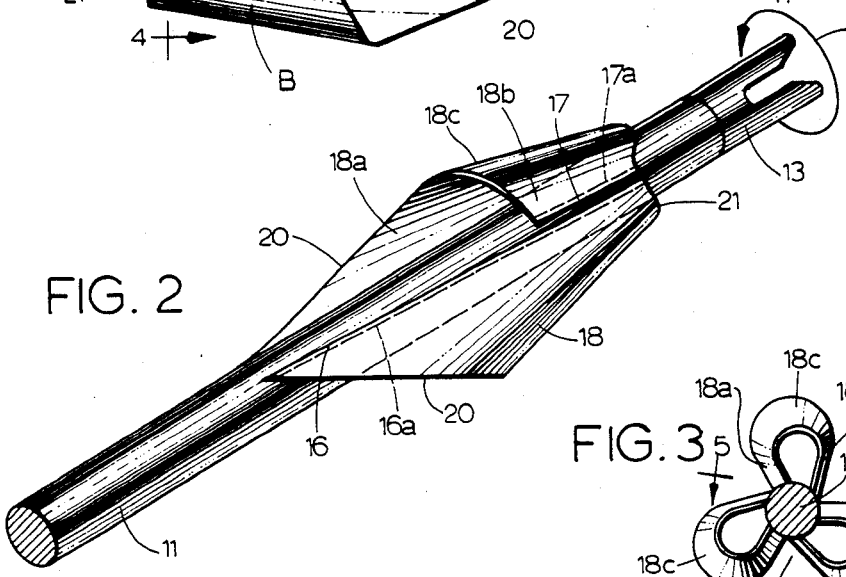
FIG. 2 is an enlarged fragmentary perspective view of the butt end portion of the first embodiment of the invention to further illustrate the vane construction and arrangement.
Figure 3:
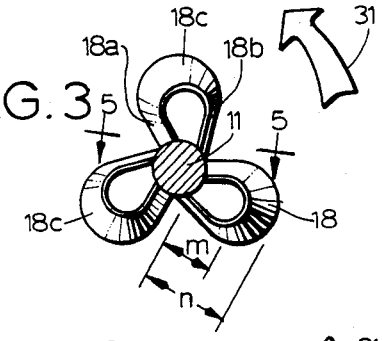
FIG. 3 is a transverse cross sectional view generally taken along the line and in the direction of the arrows of FIG. 1.
Figure 5:
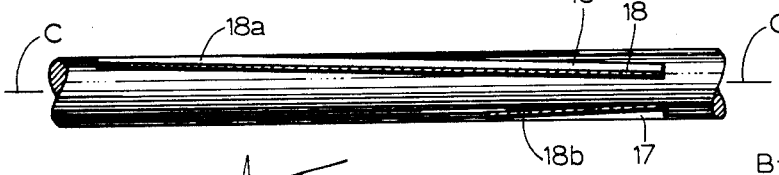
FIG. 5 is a longitudinal cross sectional view generally taken along the line and in the direction of the arrows 5—5 of FIG. 3.
Figure 4:
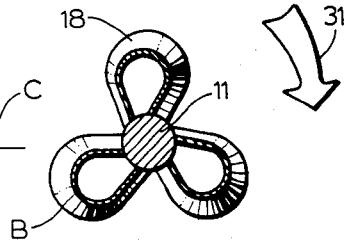
FIG. 4 is a transverse cross sectional view generally taken along the line and in the direction of the arrows 4—4 of FIG. 1.
Figure 6:
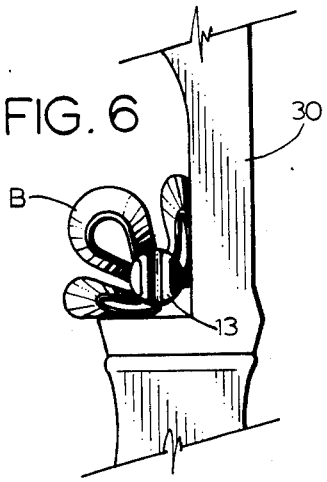
FIG. 6 is a transverse cross sectional view showing the butt end portion of the first embodiment of an arrow in flight as the butt end portion passes the bow handle, said view being taken to look in a forward direction and showing only part of the handle.

A plurality of vanes B are symetrically mounted on the shaft butt end portion, each vane being made of the same material and the same size and shape. Advantageously there are provided three vanes.

Each of the vanes is made of a piece of plastic or plastic cloth that is semi rigid. That is, each vane is of sufficient flexibility that it can collapse to extend at least partially around the shaft with the maximum radial spacing of a part of the vane remote from the shaft being substantially less than the maximum radial spacing of said part when the vane is in its datum shape. The vane material has a memory so that after the force acting against the vane to collapse it is removed, the vane returns to its datum shape shown in FIGS. 1–5. The vanes are of sufficient rigidity to substantially remain in its datum shape when the arrow is in flight and will maintain its datum shape when the vane is out of contact with a solid object other than the arrow shaft to which it is secured.

Each vane has an axially elongated first edge portion 16, an opposite axially elongated second edge portion 17 and a looped portion 18 joined to the edge portions and extending therebetween. The edge portions are secured to the shaft in angular spaced relationship with the rearwardmost part of each edge portion being substantially the same axial distance from the nock 13 while the forwardmost part of the first edge portion is located a substantial distance axially forwardly (more closely adjacent the arrow head) of the forwardmost part of the second edge portion.

For purposes of further describing the invention, the description of a vane will proceed on the assumption that the web part 18*c* of loop portion 18 is vertically above the shaft. The juncture of the first edge portion to the first leg 18*a* of the loop portion at 16*a* along its length extends angularly relative the central axis of elongation c—c of the shaft. In other words, as viewed from the front end of the arrow, the front end of the line of juncture 16*a* at the peripheral surface of the arrow shaft is located a few degrees angularly counterclockwise of the rear end of line 16*a*, for example about 6° while the corresponding line of juncture 17*a* of the second leg edge portion to the loop portion is located angularly clockwise of line 16*a*. Even though line 17*a* may extend parallel to the central axis c—c—, in the first embodiment, the front end of line 17*a* is located a few degrees clockwise of its rear end.

Leg 18*a* from line 16*a* extends upwardly away from the shaft surface to its juncture with one axial edge of web 18*c*, the web being arcuately curved to open toward the shaft surface. The opposite axial edge of the web is integrally joined to one axial edge of leg 18*b*, leg 18*b* extending downwardly therefrom toward the shaft to juncture line 17*a*. Legs 18*a* 18*b* along their lengths, may be slightly bowed to have transversely opposite bowed parts open toward the other. The legs in transverse cross sectional planes perpendicular to the central axis c—c, are more nearly parallel to one another as contrasted to extending generally radially relative the central axis. Further, the web is sloped to extend progressively closer to the shaft in a rearward direction. Thus the maximum radial spacing of the rear part of the web from the shaft is less than the maximum radial spacing of the front part of the web that extends transversely between legs 18*a*, 18*b*.

The vane has a front edge 20 that from juncture line 16*a* extends transversely in a rearward direction. Considering the vane in a flat condition (before being secured to the shaft) edge 20 extends at an acute included angle, advantageously about 20° relative line 16*a*, and advantageously is linear. Thus leg 18*a* in a rearward direction extends progressively more remote from the respective transversely adjacent part of the shaft surface along line 16*a* and is of a triangular shape when viewed from the side.

When the vane is in a flat laid out position, the rear edge 21 may be straight or slightly arcuately curved to the mid-portion thereof to extend further forwardly than the transverse opposite end portions thereof. In either case the axial lengths of the vane increase in a transverse direction from edge portion 17*a* to edge portion 16*a*.

The rear portion of the vane (from the front end of edge portion 17 and axially rearward) in conjunction with the peripheral surface of the shaft between lines 16*a*, 17*a* define a bounded space that is funnel shaped and of progressively smaller cross-sectional areas in a rearward direction. Further the maximum cross-sectional area of the bounded space is less than the cross-sectional area of the arrow shaft.

The angular spacing of the front end of each of lines 16*a* from the other two is substantially the same and is substantially equal to the angular spacing of the rear end of each of the lines 16*a* from the other (adjacent one on either side in the event more than three vanes are provided). Likewise, the angular spacing of the front end of each of lines 17*a* from the other is substantially equal to the angular spacing of the rear end of each of the lines 17*a* from the other.

Figure 7:
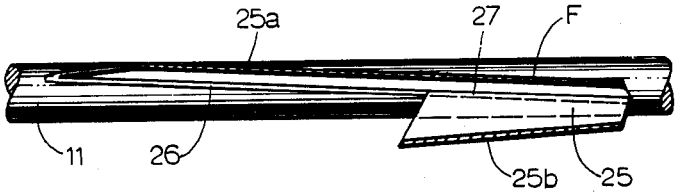
FIG. 7 is a view corresponding to FIG. 3, other than it is of the second embodiment.
Figure 8:
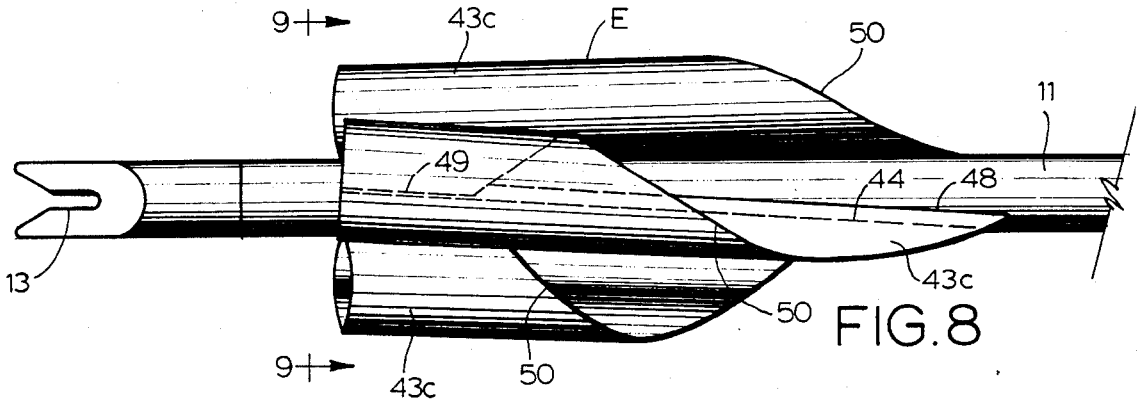
FIG. 8 is a fragmentary plan view of the rear end portion of the third embodiment.
Figure 9:
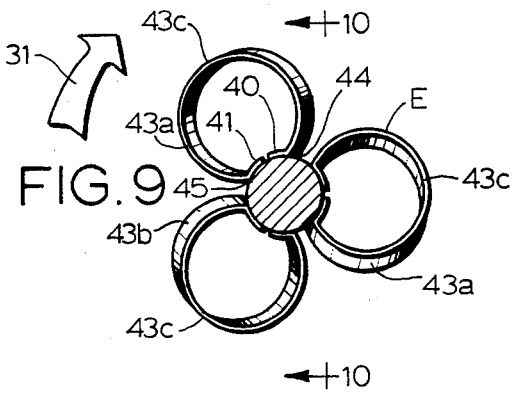
FIG. 9 is a transverse cross sectional view generally taken along the line and in the direction of the arrows 9—9 of FIG. 8.

Referring to FIG. 7, the second embodiment of the invention is the same as the first except for the differences noted hereinafter. With reference to the second embodiment, the vanes F thereof when laid out flat may be of the same shape and size as vanes B, although it is preferrable that they be of somewhat larger transverse dimensions due to the manner they are secured to the arrow shaft. Instead of having angularly spaced edge portions 16, 17, the axially longer leg 25*a* of the loop 25 of vane F is joined to edge portion 26 which extends in underlying relationship to edge portion 27 of the vane. Edge portion 26 is secured to the shaft while edge portion 27 is secured to edge portion 26. Edge portion 26 is intergrally joined to the axially shorter leg 25*b* of the loop 25. From the juncture with edge portion 27, leg 25*b* is arcuately curved in a transverse direction to extend away from leg 25*a* and from the shaft to have its opposite axially extending edge joined to the web (not shown) of loop 25. The space encircled by the vane F is of progressively smaller transverse cross sectional areas in a rearward direction.

In using the first embodiment of the invention, as the arrow is being shot and one or more vanes contact the bow handle 30 of a conventional bow, due to the curvature and the angle of extension of edge 20, as the vane contacts the handle the vane is flattened and/or partially wrapped around the shaft. In other words, the vane sufficiently collapses toward the shaft to substantially reduce the amount of deflection of the rear portion of the shaft from that which would occur if the vane did not collapse or if conventional fletches now commonly in use were used. Similarly the deflection of the arrow is reduced in the event the arrow passes too close to, for example, a branch or twig. That is, due to the relative rigidity of feather fletches commonly used in the prior art as an arrow passes close to a twig or branch, the fletch in hitting a branch or twig causes deflection of the arrow.

As an example of the first embodiment of the invention but not as a limitation thereon, with a shaft of a diameter of 9/32", the maximum radial dimension m of the rear edge 21 of vane B from the shaft is about 3/16", the maximum radial dimension n of the front edge 20 from the shaft about 3/8", the axial length of line 16*a* about 1¼', the axial length of line 16*a* from the rear end of line 17*a* about ¼".

Referring now to FIGS. 8–12, the third embodiment of the invention which may be of the same construction as the first embodiment, except for that of the vanes, includes a plurality of vanes E symetrically mounted on the shaft butt end portion. Advantageously there are three vanes E, each being made of the same material and of the same size and shape.

Each of the vanes is made of a piece of plastic or plastic cloth material which may be in part reinforced, at least along the front edge thereof. In any event each vane is semi-rigid, but is of sufficient flexibility that it can collapse in a manner described relative the first embodiment but has a memory to return to its datum shape of FIGS. 8, 9 and 11 after the force is removed that caused it to collapse.

Each vane has an axially elongated first edge portion 40, an opposite second edge portion 41 and a looped portion 43 extending between the edge portions and integrally joined at line 44 to the first edge portion and at line 45 to the opposite edge portion. Substantially the entire edge portions are secured to the shaft, for example by adhesive, with the rearwardmost part of each edge portion being substantially the same axial distance from the nock 13 while the forwardmost part of the first edge portion is located a substantial distance axially forwardly of the forwardmost part of the second edge portion. Advantageously the first edge portion is provided with a cut out 47 to have the edge portion 41 extend into when secured to the shaft whereby edge portions 40, 41 do not have to be, but can be partially overlapped when secured to the shaft 40 so that the rear part of the vane either alone or in combination with the shaft peripheral surface encompasses a path for air to flow through. With the vanes thus secured to the shaft, edge portion 40 at the cut out 47 in combination with edge portion 41 may extend angularly, for example 20–25 percent of the circumferential dimension of the shaft in adhered relationship thereto.

The juncture of the first edge portion to the first leg 43*a* of the loop portion 43 of the vane along its length extends angularly relative the central axis of the shaft in the same manner described relative the first embodiment as does the juncture of the second leg 43*b* of the loop portion to the second edge portion. As viewed from the rear end of the arrow, the rear parts of lines 44, 45 are angularly a few degrees counterclockwise from their front parts while along the axial lenght of line 44 its circumferential spacing (when the vane is mounted on the shaft) from line 45 remains substantially the same. The legs 43*a*, 43*b* in transverse planes are arcuately curved to initially transversely diverge as they extend away from the shaft and then transversely converge to be integrally joined to the loop web portion 43*c* which is transversely arcuately curved to open toward the shaft.

Figure 12:
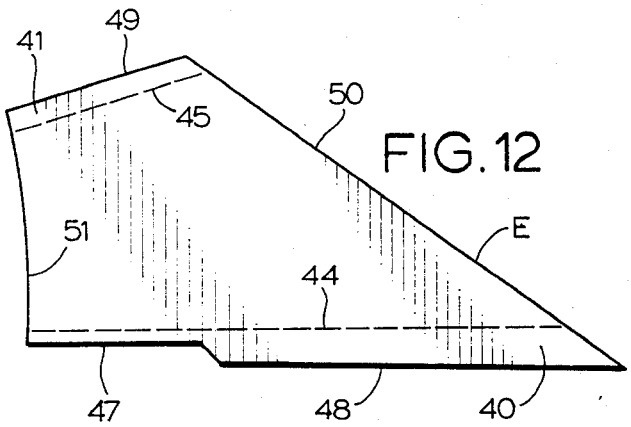
FIG. 12 is a plan view of one of the vanes of the third embodiment in a flat condition before being secured to the shaft.
Figure 10:
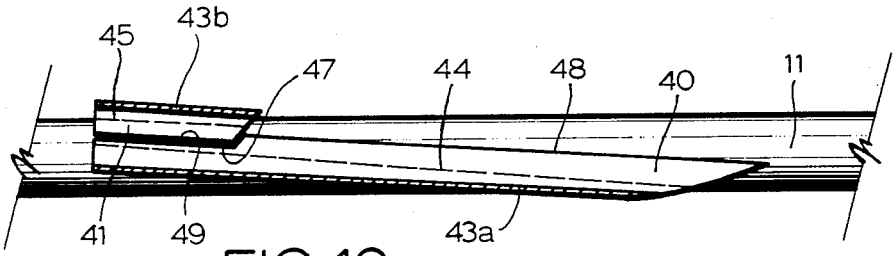
FIG. 10 is a longitudinal cross sectional view generally taken along the line and in the direction of the arrows 10—10 of FIG. 9.
Figure 11:
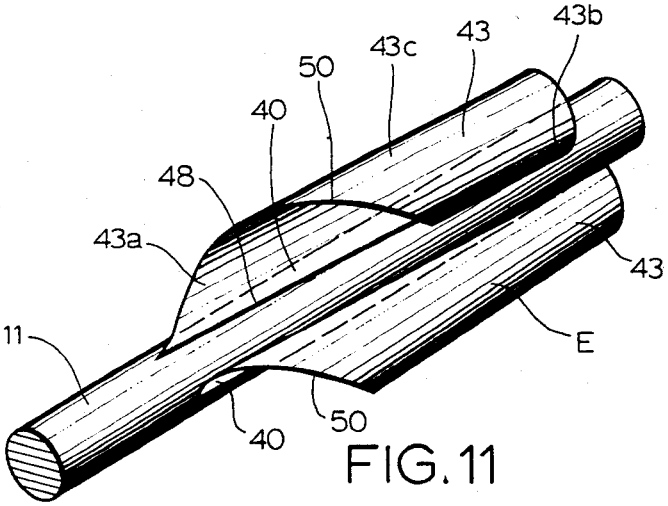
FIG. 11 is a fragmentary perspective view of the butt end portion of the third embodiment to further illustrate the vane construction and arrangement.

Considering the vane in a flat condition (before being secured to the shaft) the vane has a linear front edge 50 that from its juncture with the axial extending terminal edge 48 of the first edge portion 40 extends rearwardly at an acute angle relative thereto, for example less than 45°, to the terminal edge 49 of the vane second edge portion 41. Due to the vane being secured to the shaft to along the length of portions 40, 41 extend axially and angularly relative thereto, edge 49 converges toward edge 48 in a rearward direction. The rear edge 51 of the vane may be slightly arcuately curved such as indicated in FIG. 12. As a result the length of the vane along line 44 is substantially longer than it is along line 45.

The axially extending portion of the vane from the front end of line 45 to the rear end of the vane defines a bounded space that is of substantially the same cross sectional areas in transverse planes from one end to the other and opens both rearwardly and forwardly. This provides for even better stability of the arrow in flight, especially when shooting greater distances, than obtained with the first embodiment.

As may be noted in FIG. 12, line 44 diverges from edge 48 in a direction toward edge 50 (forward direction). Since at least substantially the entire portion 40 is adhered to the shaft, the front of the vane is flared so as to scope up more air to give a better turning action to the arrow.

Assuming there are three vanes on the arrow shaft, the angular spacing of edge 48 along the length thereof of one of the vanes from the corresponding edges of the other two vanes is substantially the same as is the angular spacing of an edge of one vane along the length thereof from the corresponding edges of the other two vanes.

Due to the vanes first legs extending axially at the previously indicated angles relative the direction of extension of the shaft central axis, as the arrow is being shoot it will rotate in the direction of arrow 31 (clockwise when viewed from the rear). However it is to be understood the vanes may be advantageously mounted on the shaft so that the shaft will rotate in the opposite direction when the arrow is being fired.

It has been found in using the vanes of this invention substantially less trajectory is required when shooting the arrow than required in using conventional arrows that presently are in common use, and less drifting occurs than when using such conventional arrows.

What is claimed:

1. An arrow that includes an axially elongated arrow shaft having a central axis, a peripheral surface, a front end and a rear end, and a plurality of vanes mounted on the shaft adjacent the shaft rear end, each vane being of a semi-rigid material and having an axially elongated first edge portion secured to the shaft, an axially elongated first leg having an axially elongated first edge joined to the first edge portion along a juncture line adjacent the shaft peripheral surface and an axially elongated second edge remote from the peripheral surface, the above mentioned juncture line having a front end and a rear end that is angularly offset relative the shaft central axis from the front end, an axially elongated transversely arcuately curved portion that is curved to open generally toward the shaft peripheral surface, the arcuately curved position having a first axially elongated edge joined to the first leg second edge, and an axially elongated second leg that has a first edge joined to the arcuately curved portion second edge and a second edge and an axially elongated second edge portion that is joined along a second line of juncture to the second leg second edge adjacent the shaft peripheral surface, the second portion being secured to at least one of the shaft and the first end portion, the second line of juncture having a front end and a rear end, the second line of juncture rear end being substantially more closely adjacent the shaft rear end than the first line of juncture front end.

2. An archery arrow that includes an axially elongated arrow shaft having a central axis, a peripheral surface, a front end and a rear end, and a plurality of vanes mounted on the shaft adjacent the shaft rear end, each of the vanes being of semi-rigid material and having an axially elongated first edge portion secured to the shaft, and an axially elongated second edge portion secured to at least one of the first edge portion and the shaft, and a transversely arcuately curved loop portion having a first edge joined to the first edge portion along an axially extending first juncture line and a second edge joined to the second edge portion along an axially extending second juncture line, the loop portion having an axially elongated web portion that is transversely arcuately curved to open toward the shaft peripheral surface, each vane having a front terminal edge that along the loop portion initially extends further outwardly from the shaft peripheral surface and thereafter inwardly toward the shaft peripheral surface in an axial rearward direction.

3. The arrow of claim 2 further characterized in that the juncture lines have front ends and rear ends angularly offset from the rear ends.

4. The arrow of claim 3 further characterized in that the loop portion in conjunction with at least one of the first edge portion, the second edge portion and shaft encompass a space that is of decreasing cross sectional areas in planes perpendicular to the central axis in a direction toward the shaft rear end.

5. The arrow of claim 3 further characterized in that the loop portion in conjunction with at least one of the first edge portion, the second edge portion and shaft encompass a space that along the length thereof is of substantial the same cross sectional area and opens both forwardly and rearwardly of the vane.

6. An arrow that includes an axially elongated arrow shaft having a central axis, a peripheral surface, a front end and a rear end, and a plurality of vanes mounted on the shaft adjacent the shaft rear end, each vane being of a semi-rigid material and having an axially elongated first end portion secured to the shaft, an axially elongated first leg having an axially elongated first edge joined to the first edge portion along a juncture line adjacent the shaft peripheral surface and an axially elongated second edge remote from the peripheral surface, the above mentioned juncture line having a front end and a rear end that is angularly offset relative the shaft central axis from the front end, an axially elongated transversely arcuately curved portion that is curved to open generally toward the shaft peripheral surface and is sloped in an axial direction to extend more closely adjacent to the shaft in a rearward direction, the arcuately curved portion having a first axially elongated edge joined to the first leg second edge, and an axially elongated second leg that has a first edge joined to the arcuately curved portion second edge and a second edge and an axially elongated second edge portion that is joined along a second line of juncture to the second leg second edge adjacent the shaft peripheral surface, the second portion being secured to at least one of the shaft and the first end portion.

7. An arrow that includes an axially elongated arrow shaft having a central axis, a peripheral surface, a front end and a rear end, and a plurality of vanes mounted on the shaft adjacent the shaft rear end, each vane being of a semi-rigid material and having an axially elongated first edge portion secured to the shaft, an axially elongated first leg having an axially elongated first edge joined to the first edge portion along a juncture line adjacent the shaft peripheral surface and an axially elongated second edge remote from the peripheral surface, the above mentioned juncture line having a front end and a rear end that is angularly offset relative the shaft central axis from the front end, an axially elongated transversely arcuately curved portion that is curved to open generally toward the shaft peripheral surface, the arcuately curved portion having a first axially elongated edge joined to the first leg second edge, and an axially elongated second leg that has a first edge joined to the arcuately curved portion second edge and a second edge and an axially elongated second edge portion that is joined along a second line of juncture to the second leg second edge adjacent the shaft peripheral surface, the second portion being secured to at least one of the shaft and the first end portion, the second leg of each vane being angularly spaced from the vanes first leg along the vanes axial length and for each vane the legs, the arcuately curved portion and the shaft peripheral surface between the legs bounding a space that is of progressively decreasing areas in an axial direction toward the shaft rear end.

8. An arrow that includes an axially elongated arrow shaft having a central axis, a peripheral surface, a front end and a rear end, and a plurality of vanes mounted on the shaft adjacent the shaft rear end, each vane being of a semi-rigid material and having an axially elongated first edge portion secured to the shaft, an axially elongated first leg having an axially elongated first edge joined to the first edge portion along a first juncture line adjacent the shaft peripheral surface and an axially elongated second edge remote from the peripheral surface, the first juncture line having a front end and a rear end that is angularly offset relative the shaft central axis from the front end, an axially elongated transversely arcuately curved portion that is curved to open generally toward the shaft peripheral surface, the arcuately curved portion having a first axially elongated edge joined to the first leg second edge, an axially elongated second leg that has a first edge joined to the arcuately curved portion second edge and a second edge and an axially elongated second edge portion that is joined along a second line of juncture to the second leg second edge adjacent the shaft peripheral surface, the second portion being secured to at least one of the shaft and the first end portion, and a front terminal edge that extends between the lines of juncture and extends rearwardly from the first line of juncture to the second line of juncture, the front terminal edge along the first leg extending away from the shaft, along the arcuately curved portion extending more remote from the central axis and then more closely adjacent to the central axis and along the second leg extending more closely adjacent to the shaft peripheral surface, the second line of juncture having a front end and a rear end, the lines of juncture rear ends being spaced from the shaft rear end substantially the same distance, the arcuately curved portion and legs of each vane and the shaft bounding a space that is of decreasing areas in planes perpendicular to the central axis in a direction toward the shaft rear end.

9. An arrow that includes an axially elongated arrow shaft having a central axis, a peripheral surface, a front end and a rear end, and a plurality of vanes mounted on the shaft adjacent the shaft rear end, each vane being of a semi-rigid material and having an axially elongated first edge portion secured to the shaft, an axially elongated first leg having an axially elongated first edge joined to the first edge portion along a first juncture line adjacent the shaft peripheral surface and an axially elongated second edge remote from the peripheral surface, the first juncture line having a front end and a rear end that is angularly offset relative the shaft central axis from the front end, an axially elongated transversely arcuately curved portion that is curved to open generally toward the shaft peripheral surface, the arcuately curved portion having a first axially elongated edge joined to the first leg second edge, an axially elongated second leg that has a first edge joined to the arcuately curved portion second edge and a second edge and an axially elongated second edge portion that is joined along a second line of juncture to the second leg second edge adjacent the shaft peripheral surface, the second portion being secured to at least one of the shaft and the first end portion, and a front terminal edge that initially extends further outwardly of the shaft peripheral surface from the first juncture line and thereafter inwardly toward the shaft peripheral surface in an axial rearward direction, the legs and the arcuately curved portion in conjuction with at least one of the edge portions and the shaft encompassing a space that along at least part of the axial length of one of the legs is of substantially the same cross sectional area.

* * * * *